US008209782B1

(12) United States Patent
Henry

(10) Patent No.: US 8,209,782 B1
(45) Date of Patent: Jul. 3, 2012

(54) MOTORCYCLE HELMET HORNS

(76) Inventor: Michael L. Henry, Las Vegas, NV (US)

( * ) Notice: Subject to any disclaimer, the term of this patent is extended or adjusted under 35 U.S.C. 154(b) by 288 days.

(21) Appl. No.: 12/755,050

(22) Filed: Apr. 6, 2010

(51) Int. Cl.
*A42B 1/24* (2006.01)

(52) U.S. Cl. ..... 2/422; 2/209.13; 2/244; D2/895

(58) Field of Classification Search ..... 2/209.13, 2/422, 244, 6.6, 425, 410, 171, 175.3; 40/329; 472/133, 70; 446/27; D2/895, 866, 870
See application file for complete search history.

(56) References Cited

U.S. PATENT DOCUMENTS

| | | | | | |
|---|---|---|---|---|---|
| 488,188 | A | * | 12/1892 | Drake | 2/244 |
| D179,967 | S | * | 4/1957 | Erickson | D29/104 |
| 3,381,308 | A | * | 5/1968 | Fineberg | 2/182.6 |
| D396,940 | S | * | 8/1998 | Clegg | D2/869 |
| D399,337 | S | * | 10/1998 | Saunders et al. | D2/873 |
| 5,903,925 | A | * | 5/1999 | Engebretson | 2/209.13 |
| 6,000,063 | A | * | 12/1999 | Sullivan | 2/209.13 |
| 6,101,636 | A | * | 8/2000 | Williams | 2/410 |
| D442,746 | S | * | 5/2001 | Belcher | D29/122 |
| D458,735 | S | * | 6/2002 | Cook et al. | D2/869 |
| 6,505,351 | B2 | * | 1/2003 | Yeh | 2/206 |
| 6,848,122 | B1 | * | 2/2005 | Meeds | 2/422 |
| 7,114,198 | B1 | * | 10/2006 | Hsieh et al. | 2/422 |
| 7,398,562 | B2 | * | 7/2008 | Mollo | 2/425 |
| D611,200 | S | * | 3/2010 | Packard | D29/122 |
| 2003/0150047 | A1 | * | 8/2003 | Hyman | 2/209.13 |
| 2011/0307994 | A1 | * | 12/2011 | Woloschuk | 2/102 |

* cited by examiner

*Primary Examiner* — Amy Vanatta
(74) *Attorney, Agent, or Firm* — Gold & Rizvi, P.A.; Glenn E. Gold; H. John Rizvi

(57) ABSTRACT

A motorcycle helmet enhancing horn having a horn shaped, hollow body initiating at a broad base tapering to a distal point. The horn arches is formed about a curved central axis spanning between a center of the broad base and a central point of the distal end. The central axis can be a single or compound curved shape. A mounting flange supports the horn body. The mounting flange is contiguous about and extends substantially perpendicularly outward from the base edge. An adhesive is applied to the bonding surface of the mounting flange for securing the horn to a motorcycle helmet. The horns can be provided in mirror image pairs having individual flanges or in a series assembled in a linear, spatial arrangement on a single flange. The flanges are shaped in a compound curve for mating to an outer surface of a motorcycle helmet.

19 Claims, 5 Drawing Sheets

MOTORCYCLE HELMET HORNS

FIELD OF THE INVENTION

The present disclosure generally relates to an apparatus and method for a helmet ornament. More particularly, the present disclosure relates to a horn shaped ornament comprising a mounting flange for affixing onto a helmet.

BACKGROUND OF THE INVENTION

The present invention provides a horn or pair of horns for attachment to a helmet via a mounting flange and adhesive.

Motorcycle enthusiasts generally strive for individuality and uniqueness. A significant amount of investment is made into the motorcycle, the clothing and the helmet. The enthusiast customizes various items, providing an association or identify. Additionally, the enthusiasts focus upon quality. The quality includes form, fit, and function.

Motorcycle helmets are generally finished having a smooth, domed outer surface. A retailer has developed and is marketing a Mohawk comprising a series of feathers, hair, and the like extending upwards from a mounting strip. The mounting base is a planar strip, which is not conducive to the three-dimensional curves of the helmet's domed outer surface.

What is desired is an accessory that provides a unique and distinct appearance while providing a quality assembly process for a novice to accomplish.

SUMMARY OF THE INVENTION

The basic inventive concept provides one, a pair or plurality of horns having a mounting flange formed about a base periphery. The horns are formed having a horn shaped exterior and a hollow interior to minimize weight. The flange is shaped having a short, planer width about a complex curved periphery.

A first aspect of the present invention provides a helmet horn accessory comprising:

a horn formed by a hollowed shell having a wide rounded attachment end tapering to a pointed end, wherein the sidewall shapes are arched;

a base edge being provided about a periphery of the attachment end of the horn, the base edge being formed following a complex curve to mate to an outer surface of an outer surface of a helmet;

a mounting flange formed extending outward from the base edge, conforming to the complex curve; and an adhesive for attaching a bonding surface of the mounting flange to the surface of the helmet.

A second aspect of the present invention provides a pair of horns, a first horn having a first shape and a second horn being a mirror image of the first shape.

In yet another aspect, is an inclusion of a flattened portion of the horn exterior shaped between the base edge and the pointed end, the planar portion being approximately ¼ of the circumference of a cross sectional portion of the horn body.

While in another aspect, a series of like-shaped horns are attached in a linear, spatial arrangement along a single, arched mounting flange.

And in another aspect, the horns are formed of a plastic, a composite material (fiberglass, KEVLAR, carbon fiber, etc.), and the like.

In another aspect, the adhesive can be double sided tape, glue, epoxy (single or multi-compound), cyanoacrylate, and the like.

In yet another aspect, the adhesive can be selected from natural adhesives, synthetic adhesives, drying adhesives, contact adhesives, hot adhesives, emulsion adhesives, UV and light curing adhesives, and pressure sensitive adhesives.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
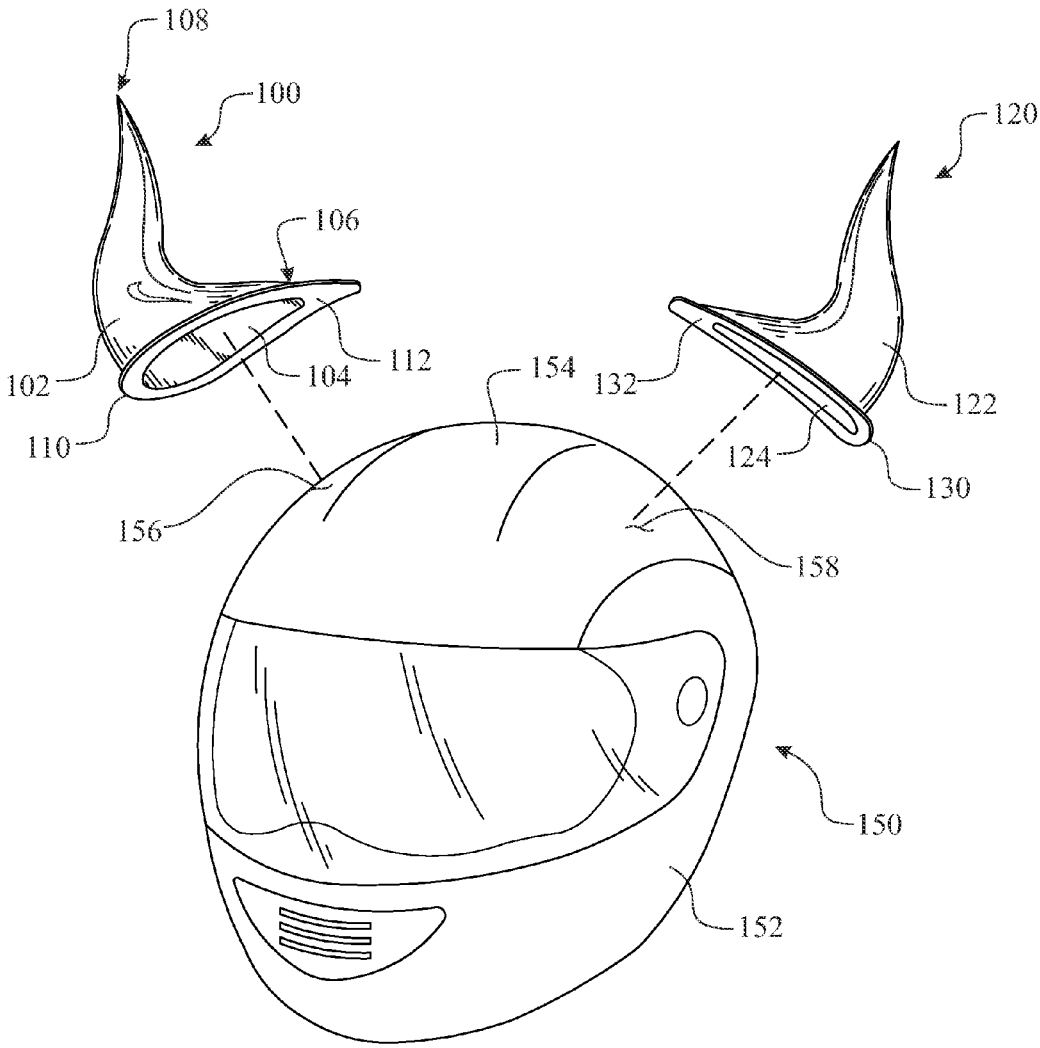
FIG. 1 presents a perspective exploded assembly view of the basic elements of the horn accessory configuration.

An exemplary horn, referenced as 100 and 120 are presented in FIG. 1 with horns have alternate exemplary shapes illustrated in FIGS. 2 through 7. The horns 100, 120 are provided individually or in pairs, such as the right horn 100 and the left horn 120 illustrated herein. Each horn comprises a horn body 102, 122. The right horn body 102 is conically shaped having a horn base edge 106 tapering to a horn tip 108. The conical shape is additionally curved along the horn length. The curves can be defined as being a complex curve along a central axis 103. The curve positions a first central point on a first side of the axis 103 and a second central point on an opposite side of the central axis 103. The right horn body 102 is generally hollow creating a horn hollow interior 104 to reduce material consumption and weight.

The right horn 100 and left horn 120 are assembled to the motorcycle helmet assembly 150 at a right horn receiving region 156 and left horn receiving region 158 respectively. The right horn 100 is designed to be adhesively fastened to a motorcycle helmet assembly 150. The motorcycle helmet assembly 150 includes a motorcycle helmet 152 having a helmet upper surface 154. The horn base edge 106 can be defined as the contacting edge. The horn base edge 106 is shaped having a complex curve adhering to a contour of an exterior of the motorcycle helmet assembly 150, more specifically the right horn-receiving region 156. A right horn mounting flange 110 supports the right horn body 102. A mounting surface 112 is created about a bottom side of the right horn mounting flange 110. The right horn mounting flange 110 is contiguous about and extends substantially perpendicularly outward from the horn base edge 106. A mounting surface 112 is provided on the attachment side of the right horn mounting flange 110. The right horn mounting flange 110 is designed to provide continuous contact with a surface of a helmet 150 warranting against wind entrapment and providing a quality appearance. The left horn 120 is a mirror image of the right horn 100. The left horn 120 comprises a left horn body 122. The left horn body 122 is generally hollow creating a horn hollow interior 124 to reduce material consumption and weight. A left horn mounting flange 130 supports the left horn body 122. The left horn mounting flange 130 is disposed contiguously about an attachment edge of the left horn body 122. A mounting surface 132 is created about a bottom side of the left horn mounting flange 130. The horns 100, 200 are fabricated of a plastic, a composite material (fiberglass, KEVLAR, carbon fiber, etc.), and the like. The plastic can be injection molded or vacuum formed. The plastic can maintain the natural plastic finished or be painted in any of many colors, combinations of colors, graphics, shadowing, and the like. Some exemplary paint schemes include a metallic-pearl green, lime green, blue, red, pink, black, white, and the like. Alternately, the horns 100, 120 can be finished with a metallic plating process such as chrome plating, gold plating, nickel plating, and the like. It is understood that the horns 100, 120 can be finished with any combination of finish as well.

Figure 2:
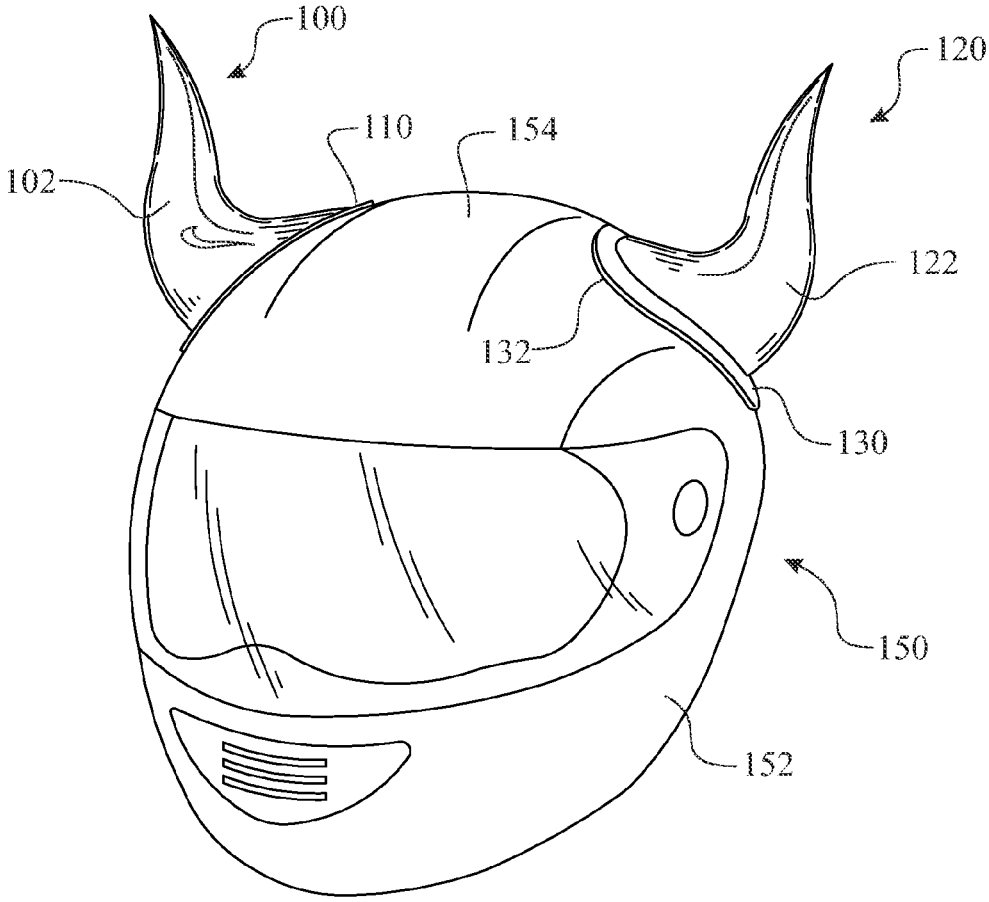
FIG. 2 presents a perspective view of FIG. 1, illustrating the pair of horns assembled to an exemplary motorcycle helmet.
Figure 3:
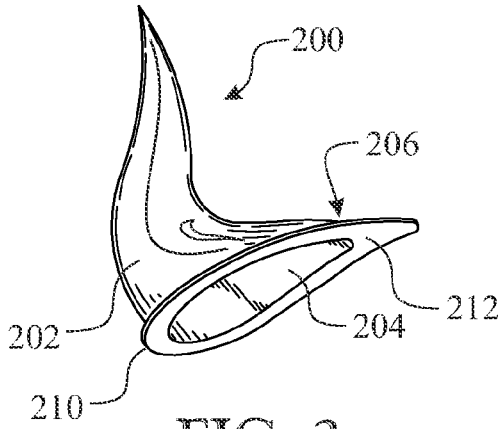
FIG. 3 presents a perspective view of the horn having a first alternate exemplary shape.
Figure 4:
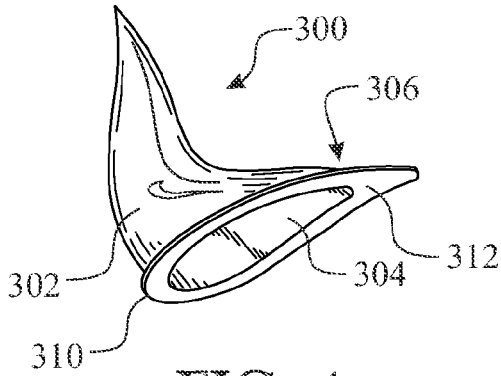
FIG. 4 presents a perspective view of the horn having a second alternate exemplary shape.
Figure 5:
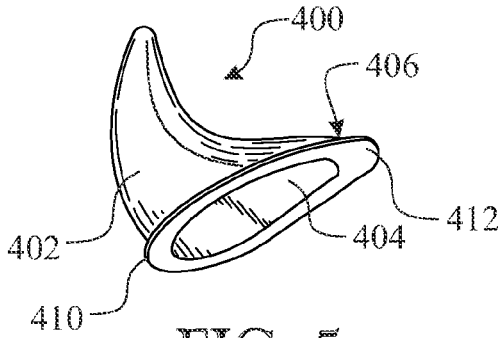
FIG. 5 presents a perspective view of the horn having a third alternate exemplary shape.

An adhesive is applied to the mounting surface 112 for joining the right horn 100 to the right horn receiving region 156 of the motorcycle helmet assembly 150. The adhesive can be selected from natural adhesives, synthetic adhesives, drying adhesives, contact adhesives, hot adhesives, emulsion adhesives, UV and light curing adhesives, and pressure sensitive adhesives. The preferred adhesives include double sided tape, glue, epoxy (single or multi-compound), cyanoacrylate, and the like. The right horn receiving region 156 would be cleaned with a cleaning solvent, such as soap and water, alcohol, and the like. The cleaning solution would be selected such to ensure the surface finish of the motorcycle helmet 152 would not be damaged. Where a bonding compound is used, a tape can be applied about the right horn receiving region 156 to protect the finish of the motorcycle helmet 152. The adhesive is applied to the mounting surface 112 in accordance with the directions of the selected adhesive. The right horn 100 is carefully aligned, then directly placed upon the right horn receiving region 156. If applicable, the assembly can be taped together to temporarily hold the right horn 100 in position while the adhesive cures. The process is repeated to attach the left horn 120 to the left horn receiving region 158. The finished assembly is illustrated in FIG. 2.

The horn 100 can be of any reasonable shape. Several exemplary shapes are presented in FIGS. 3 through 6. The following table presents descriptions for each of the elements:

| Ref. No's | Description |
|---|---|
| 200, 300, 400, 500 | horn |
| 202, 302, 402, 502 | horn body |
| 204, 304, 404 | horn body hollow interior |
| 206, 306, 406, 506 | horn base edge |
| 210, 310, 410, 510 | horn mounting flange |
| 212, 312, 412, 512 | horn adhesive mounting surface |

Figure 6:
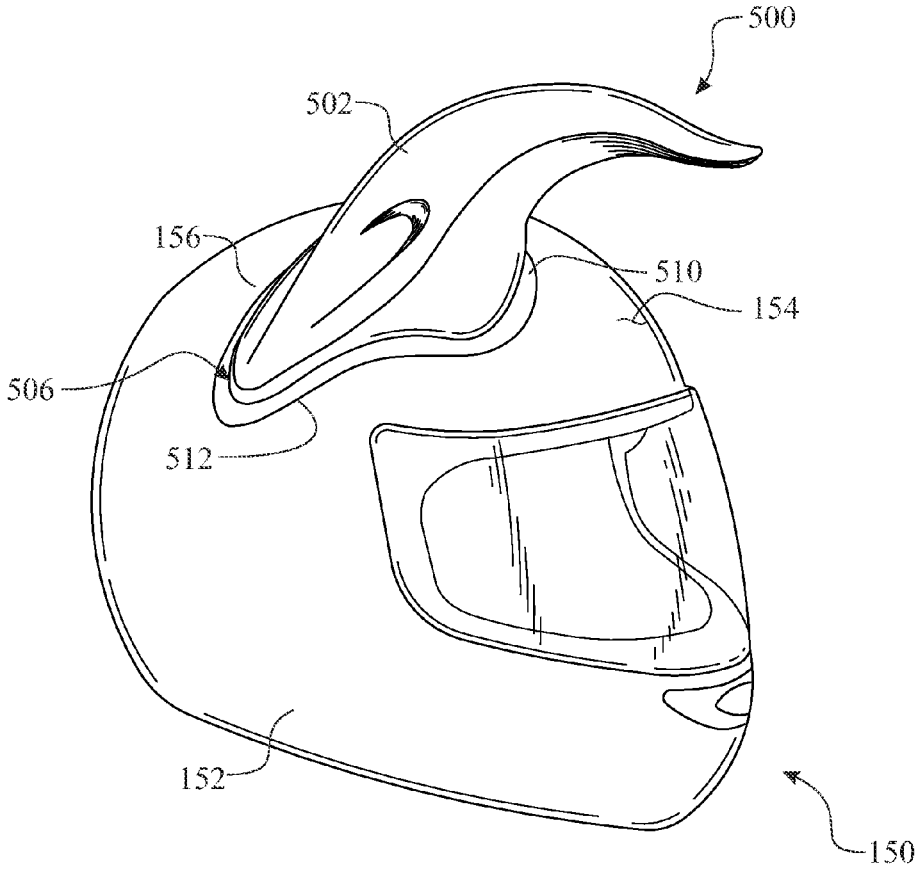
FIG. 6 presents a perspective view of the horn having a forth alternate exemplary shape affixed to the helmet.
Figure 7:
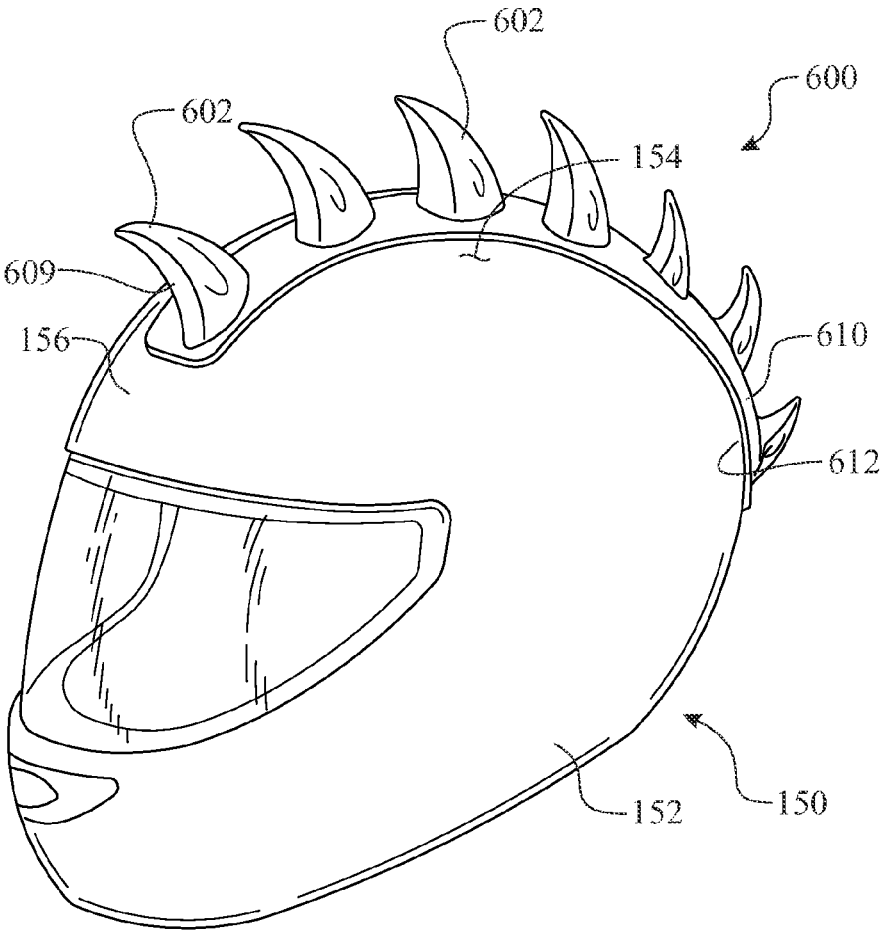
FIG. 7 presents an alternate configuration, incorporating a series of like-shaped horns attached in a linear, spatial arrangement along a single, arched mounting flange.

It is understood the illustrated horns would be provided with a mating, mirror shaped horn. The second exemplary horn 200 is shaped being gradually tapering to a point, presenting a narrower overall appearance. Additionally, the curves are more pronounced. The third exemplary horn 300 is generally shorter and stockier in the overall shape. Each of the second exemplary horn 200 and third exemplary horn 300 are formed having compound curves along the central axis 103 of the horn 200, 300. The fourth exemplary horn 400 is generally shorter and shaped having a single curve along the central axis of the horn 400. The fifth exemplary horn 500, as illustrated in the assembled view of FIG. 6, presents horn 500 having a complex curved horn base 506 providing an enhanced, sculptured shaped horn 500. The central axis of the horn 500 provides a first curved portion blending into an opposing curved portion. Additionally, the horn body 502 is segmented into several planar sections 509, as opposed to a simple, cylindrical cross sectional shape. The various planar surfaces 509 aid in the airflow when riding to higher speeds.

The previously presented horn versions are provided in pairs and placed laterally upon a helmet. A centered horn 600 comprises a series of horn body 602 are linearly and spatially positioned along a mounting flange 610. The mounting flange 610 is preferably of a compound curve shape to contour to the outer surface of the motorcycle helmet 152. The series of horn body 602 can be of similar sizes or sequentially shrinking in size as illustrated. A mounting surface 612 is provided in the contacting side of the mounting flange 610. Adhesive is applied to the mounting surface 612 to secure the centered horn 600 to the motorcycle helmet assembly 150. An additional, optional feature of the horns is the inclusion of a planar section 609 of the horn body 602. The planar surface 609 can be incorporated in the horn bodies of any of the exemplary embodiments.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A helmet horn accessory comprising:

a horn formed by a hollowed shell having a wide rounded attachment end tapering to a pointed end, wherein the sidewall shapes are arched;

a base edge being provided about a periphery of the attachment end of the horn, the base edge being formed following a complex curve to mate to an outer surface of a helmet;

a mounting flange formed extending outward from and is contiguous about the base edge, conforming to the complex curve; and an adhesive for attaching a bonding surface of the mounting flange to the surface of the helmet.

2. A helmet horn accessory as recited in claim 1, the horn being formed of a molded plastic.

3. A helmet horn accessory as recited in claim 1, wherein the adhesive is selected from a group of adhesives, the adhesives group consisting of:

natural adhesives,
synthetic adhesives,
drying adhesives,
contact adhesives,
hot adhesives,
emulsion adhesives,
UV and light curing adhesives, and
pressure sensitive adhesives.

4. A helmet horn accessory as recited in claim 1, wherein the adhesive is a double-sided tape.

5. A helmet horn accessory as recited in claim 1, wherein a portion of the horn surface further comprises a substantially planar section extending between the base edge and the pointed end.

6. A helmet horn accessory as recited in claim 1, further comprising at least one finish applied to the horn, the finish being selected from a finish group consisting of painting and metal plating.

7. A helmet horn accessory as recited in claim 1, further comprising a series of like-shaped horns arranged in a spatial linear arrangement along a single mounting flange, the mounting flange having a compound curve shape to mate to a longitudinal line along the outer surface of the helmet.

8. A helmet horn accessory comprising:

a first horn and a second horn, each horn formed by a hollowed shell having a wide rounded attachment end tapering to a pointed end, wherein the sidewall shapes are arched;

a base edge being provided about a periphery of the attachment end of the horn, the base edge being formed following a complex curve to mate to an outer surface of a helmet;

a mounting flange formed extending outward from the base edge, conforming to the complex curve;

wherein the second horn is a mirror image of the first horn; and an adhesive for attaching a bonding surface of the mounting flange to the surface of the helmet.

9. A helmet horn accessory as recited in claim 8, the horn being formed of a molded plastic.

10. A helmet horn accessory as recited in claim 8, wherein the adhesive is selected from a group of adhesives, the adhesives group consisting of:

natural adhesives,
synthetic adhesives,
drying adhesives,
contact adhesives,
hot adhesives,
emulsion adhesives,
UV and light curing adhesives, and
pressure sensitive adhesives.

11. A helmet horn accessory as recited in claim 8, wherein the adhesive is a double-sided tape.

12. A helmet horn accessory as recited in claim 8, wherein a portion of the horn surface further comprises a substantially planar section extending between the base edge and the pointed end.

13. A helmet horn accessory as recited in claim 8, further comprising at least one finish applied to the horn, the finish being selected from a finish group consisting of painting and metal plating.

14. A helmet horn accessory comprising:

a horn formed by a hollowed shell having a wide rounded attachment end tapering to a pointed end, wherein the sidewall shapes are arched;

at least one planar surface area extending between the wide rounded attachment end and the pointed tip;

a base edge being provided about a periphery of the attachment end of the horn, the base edge being formed following a complex curve to mate to an outer surface of a helmet;

a mounting flange formed extending outward from and is contiguous about the base edge, conforming to the complex curve; and an adhesive for attaching a bonding surface of the mounting flange to the surface of the helmet, wherein the pointed end extends forward from the base edge when attached to the helmet.

15. A helmet horn accessory as recited in claim 14, the horn being formed of a molded plastic.

16. A helmet horn accessory as recited in claim 14, wherein the adhesive is selected from a group of adhesives, the adhesives group consisting of:

natural adhesives,
synthetic adhesives,
drying adhesives,
contact adhesives,
hot adhesives,
emulsion adhesives,
UV and light curing adhesives, and
pressure sensitive adhesives.

17. A helmet horn accessory as recited in claim 14, wherein the adhesive is a double-sided tape.

18. A helmet horn accessory as recited in claim 14, further comprising at least one finish applied to the horn, the finish being selected from a finish group consisting of painting and metal plating.

19. A helmet horn accessory as recited in claim 14, further comprising a series of like-shaped horns arranged in a spatial linear arrangement along a single mounting flange, the mounting flange having a compound curve shape to mate to an longitudinal line along the outer surface of the helmet.

* * * * *